United States Patent [19]

Habich et al.

[11] 4,370,071

[45] * Jan. 25, 1983

[54] PRINT PACKAGE

[75] Inventors: Adolph B. Habich; Ronald E. Hunt, both of Austin, Tex.

[73] Assignee: International Business Machines Corp., Armonk, N.Y.

[ * ] Notice: The portion of the term of this patent subsequent to Apr. 28, 1998, has been disclaimed.

[21] Appl. No.: 215,603

[22] Filed: Dec. 12, 1980

Related U.S. Application Data

[63] Continuation of Ser. No. 968,320, Dec. 11, 1978, abandoned.

[51] Int. Cl.[3] ..... B41J 1/30

[52] U.S. Cl. ..... 400/144.2; 400/175

[58] Field of Search ..... 400/144.2–144.4, 400/175, 248–248.2, 521, 536; 206/309, 444; 312/10; 360/133, 135

[56] References Cited

U.S. PATENT DOCUMENTS

| | | | |
|---|---|---|---|
| 1,172,854 | 2/1916 | Wernery | 400/537 |
| 3,805,697 | 4/1974 | Mahe | 101/111 |
| 3,887,055 | 6/1975 | Pastrick | 400/538 X |
| 3,926,312 | 12/1975 | Elliott et al. | 206/444 |
| 4,124,312 | 11/1978 | Johnson | 400/320 X |
| 4,127,335 | 11/1978 | Bogert et al. | 400/175 X |

OTHER PUBLICATIONS

*IBM Tech. Disc. Bulletin,* T. M. Paulson, vol. 18, No. 9, Feb. 1976, p. 2943.

*Primary Examiner*—Paul T. Sewell

*Attorney, Agent, or Firm*—James H. Barksdale, Jr.

[57] ABSTRACT

A daisy wheel printer print package including a daisy wheel print element and a cartridge. The cartridge is adapted to have the print element inserted thereinto and maintained in a latched and properly oriented position for either acceptance by a printer or storage and shipping. When the package is installed in a printer, the print element is adapted to be unlatched for rotation within the cartridge for printing. Also, the cartridge is adapted to have the print element unlatched and removed therefrom.

39 Claims, 6 Drawing Figures

FIG. 3
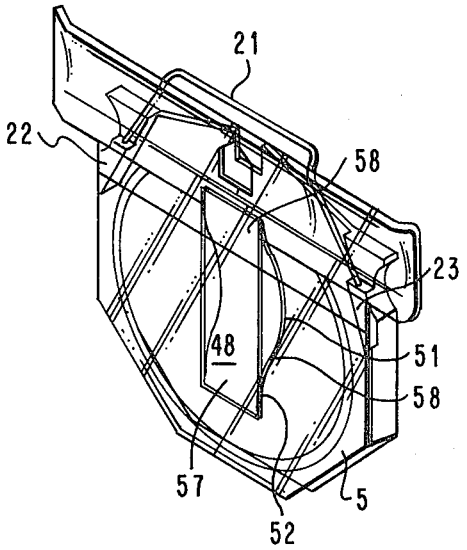
FIG. 4
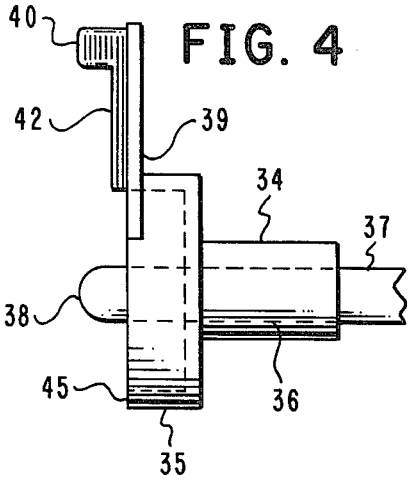
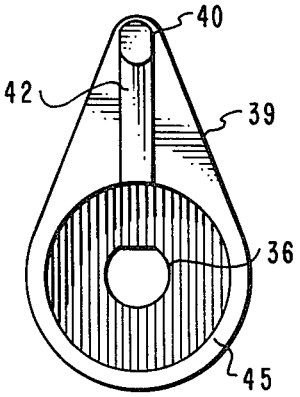
FIG. 5
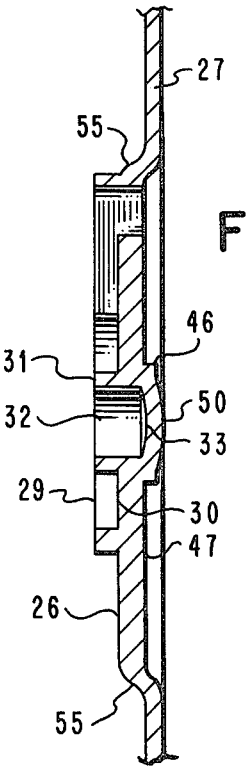
FIG. 6

PRINT PACKAGE

DESCRIPTION

This is a continuation of application Ser. No. 968,320 filed Dec. 11, 1978, abandoned.

CROSS-REFERENCES TO OTHER RELATED APPLICATIONS

U.S. patent application Ser. No. 968,322, filed Dec. 11, 1978, entitled "Print Element", and having A. B. Habich et al. as inventors.

U.S. patent application Ser. No. 968,321, filed Dec. 11, 1978, entitled "Print Element Cartridge", and having A. B. Habich et al. as inventors.

BACKGROUND OF THE INVENTION

1. Field of the Invention

This invention generally relates to print elements for daisy wheel printers. More specifically, this invention relates to a daisy wheel printer print package including a daisy wheel print element housed in a cartridge for printing and storage.

2. Description of the Prior Art

Representing other work in this same area is U.S. Pat. No. 4,127,335, having Bogert et al. as inventors and entitled "Impact Printer With Cartridge Print Wheel". Disclosed therein are a cartridge and a daisy wheel print element or wheel for use in a daisy wheel printer.

In considering the referenced application in conjunction with the instant application, there are a number of notable similarities. In both applications there are generally disclosed (1) a print element and a cartridge for housing the print element during printing and storage, (2) a leaf spring for acting against a centered bearing projection on the central hub of the print element, (3) a print hammer slot in the upper portion of the front of the cartridge, (4) a centralized opening in the front of the cartridge for accepting a selection motor drive hub and a portion of the central hub, (5) locating and driving means associated with both the print element central hub and drive hub, and (6) the displacement of the print element fromthe front of the cartridge during printing.

Even though these similarities exist, important distinctions are present. To begin with, the cartridge of the instant application substantially encloses the print element to prevent print element damage and soiled hands. In the referenced application, the cartridge does not include a back and a relatively large print hammer slot is provided. Thus, large areas of the print element remain exposed to an operator or other objects. The leaf spring in each application serves the purposes of (1) providing a bearing surface for a print element projection, and (2) urging the print element toward the front of the cartridge. In the instant application though, the leaf spring is structured, located, and oriented to facilitate removal and insertion of the print element with great ease. Also, elaborate mounting apparatus for the leaf spring is eliminated in the instant application. The centralized opening in the front of the cartridge of the referenced application apparently has nothing to do with latching the print wheel in a desired rotational position. In the same light, the print element apparently has no means for insuring its proper orientation within the cartridge.

Representative of yet other work in this same area is U.S. Pat. No. 4,124,312, issued Nov. 7, 1978, to Johnson and entitled "Impact Printer With Print Wheel Cartridge". As was the case with the Bogert et al. patent, Johnson discloses a print element housed in a cartridge. There are also definite similarities between the instant application and Johnson. In fact, Johnson overcomes a deficiency of Bogert et al. in that the print element is substantially enclosed in the cartridge. Important and basic distinctions exist, though. In Johnson, the print element and cartridge are engageable and disengageable, but upon engagement, the print element is not latched against rotation. At best, it is only frictionally held in place upon engagement of the opening in the cartridge and hub on the print element. The hub and opening serve locating and not latching purposes. The print element can still be rotated in place against friction and without any disengagement and unlatching of the print element and cartridge.

Prior art consisting of U.S. Pat. Nos. 3,793,951, 3,805,698, 3,730,602, 4,074,798, Des. 229,427, 3,860,248, 3,797,035, and floppy discs has also been considered relative to this application. A floppy disc is simply a circular magnetic recording medium housed in a folder during recording use and non-use. U.S. Pat. Nos. 3,793,951 and 3,805,698 disclose enclosed chain or belt print elements. U.S. Pat. Nos. 3,860,248, 3,730,602 and Des. 229,427 disclose a cartridge for a magnetic recording disc such as that shown in U.S. Pat. No. 3,797,035. The disc of U.S. Pat. No. 3,797,035 can be stored in one of the cartridges of U.S. Pat. Nos. 3,860,248, 3,730,602, and Des. 229,427 prior to and following recording. U.S. Pat. No. 4,074,798 discloses a daisy wheel print element having substantial central hub structure unassociated with a cartridge. Of the art mentioned in this paragraph, none is considered particularly pertinent. In fact, the majority of this art falls in an area non-analogous to printing.

Other distinctions over the prior art, and the advantages thereof, will become more readily apparent when reference is made to the accompanying drawing and the following description of the preferred embodiment.

SUMMARY OF THE INVENTION

A print package is provided for a daisy wheel printer. The print package is made up of a daisy wheel print element and a cartridge for housing the print element during both printing and storage. The cartridge is structured to substantially enclose the print element and is adapted to have the print element readily inserted thereinto and removed therefrom. The print element has a dish shaped central hub from which character petals radially extend. On the protruding side of the central hub is an orientation protrusion. A matching orientation opening is provided in the cartridge for accepting (1) the orientation protrusion on the print element prior to and following printing and (2) a selection motor drive hub utilized for rotating the print element during printing. A leaf spring is included in the cartridge for urging the orientation protrusion toward the orientation opening. During storage or shipping the orientation protrusion and orientation opening are in engagement and the print element is latched in a desired rotational position. During printing, the print element is displaced from the orientation opening by the drive hub, and as such, the print element is unlatched for rotation within the cartridge.

BRIEF DESCRIPTION OF THE DRAWING

FIG. 3 is a rear perspective view of the cartridge portion of the print package shown in FIG. 1.

FIG. 4 is a side view of the drive hub illustrated in FIG. 1.

FIG. 5 is a front face view of the drive hub illustrated in FIG. 1.

FIG. 6 is a vertical diameter cross-sectional view of the print element shown in FIGS. 1 and 2.

DESCRIPTION OF THE PREFERRED EMBODIMENT

Figure 1:
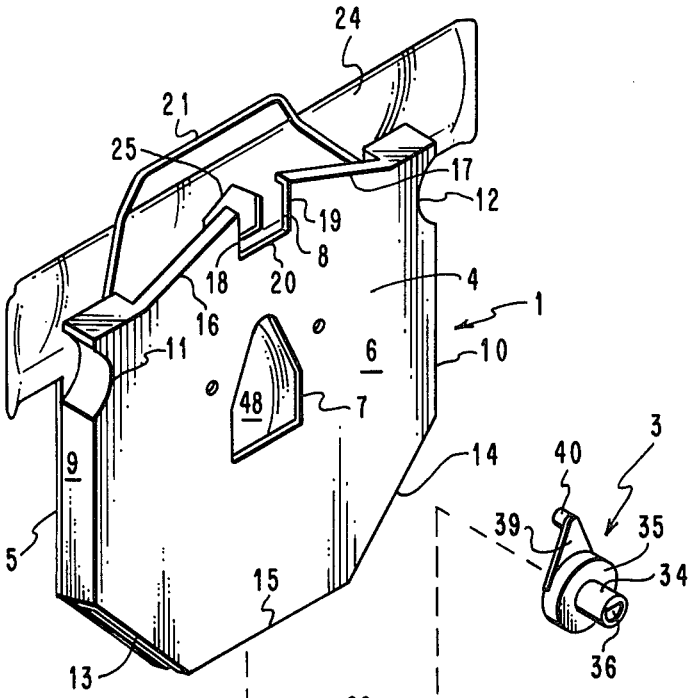
FIG. 1 is a front perspective view of the print package according to this invention with the print element removed from the cartridge. Also illustrated is a selection motor drive hub for causing rotation of the print element.

For a detailed understanding of the invention, reference is first made to FIG. 1. In this figure there is shown a cartridge generally designated by reference numeral 1, a daisy wheel printer print element generally designated by reference numeral 2, and a selection motor drive hub generally designated by reference numeral 3. Cartridge 1 and print element 2 make up the print package of this invention. During actual printing operations, element 2 is housed and rotated within cartridge 1 by hub 3.

Before further discussing each of elements 1–3, the following additional background information is deemed in order. In a normal daisy wheel printer arrangement, the mounting of a daisy wheel print element on a selection motor drive hub requires substantial operator interaction in terms of apparatus manipulation. Also, the mounting apparatus is often elaborate. For example, in one common embodiment a knob is secured to the center of the print side of the print element to provide an operator with a handle. On the opposite side of the print element is an opening for accepting a selection motor drive hub or shaft. The operator procedure is to grasp the print element knob, rotationally orient the print element, and force the print element onto the drive shaft. Forcing is required since there is a press or interference fit between the print element opening and the drive shaft. Prior to this operation though, the motor must be withdrawn or tilted to provide sufficient room in the print mechanism area for an operator to gain access to change or install the print element. Even at this, space is tight and the chance of soiled hands is great. After both operations have been completed, the mere handling of the removed print element often results in soiled hands.

The print package of this invention aids in substantially minimizing the above noted problems. Ignoring motor withdrawal which is improved in a manner to be described in a copending application, working space is not a consideration. This is since the instant print package is adapted to be vertically inserted into an accepting printer from a location exterior of the limited space print mechanism area. Also, since the print element is substantially totally enclosed in the cartridge, the mere changing of the package for a print element change all but eliminates the possibility of soiled hands.

With the above in mind, reference is again made to FIG. 1 and specifically to cartridge 1. Cartridge 1 is essentially made up of a shell 4 and a back cover 5. Shell 4 has a front 6 having an orientation opening 7 and a print hammer slot 8. Front 6 faces a print mechanism including a selection motor and a print hammer carried by a printer carrier. Slot 8 is for accommodating the print hammer which is used in a well known manner to facilitate printing. Orientation opening 7 is somewhat arrowhead in shape and generally centralized within front 6. Opening 7 is for cooperating with print element 2 to maintain print element 2 properly orientated during non-use as will be described later herein. Integral with front 4 are sides 9 and 10. Sides 9 and 10 have recesses 11 and 12, respectively, which accommodate an operator's thumb and finger for grasping cartridge 1. The lower portion of front 6 has converging tapered edges 13 and 14 which terminate with bottom edge 15. Shell 4 has no side walls along either tapered edges 13 and 14 or bottom edge 15. The outer periphery of back 5 is symmetrical with the periphery of front 6 from recesses 11 and 12 of sides 9 and 10 to bottom 15. Thus, when shell 4 is connected to back 5, cartridge 1 is provided with an open bottom which serves as a loading opening for the insertion and removal of print element 2.

Tapered edges 13 and 14 and the matching portion of back 5 serve two useful purposes. One is that the corners thus eliminated reduce the mass of the cartridge which is carried by a printer carrier during printing operations. The other is that guides are provided for inserting the cartridge into an accepting receptacle on the carrier.

The upper portion of shell 4 has ramps 16 and 17 which extend from adjacent recesses 11 and 12 to near the top center of shell 4 and terminate in slot 8. Slot 8 has sides 18 and 19 and a bottom 20. Slot 8 is large enough to permit clear passage of a print hammer during printing, yet small enough to reduce the chances of an operator having thumb or finter access to print element 2. That is, operator access to print element 2 is restricted by the size of slot 8. Ramps 16 and 17 are to provide enclosure of the upper portion of print element 2 when housed in cartridge 1, and permit as much operator writing line viewing as possible.

Shell 4 carries ribbon guide 21 which can be made up of a metallic wire rod shaped as shown. Referring for a moment to FIG. 3, the interior of shell 4 has integral internal abutments 22 and 23 having openings therein for accepting the ends of ribbon guide 21. Ribbon guide 21 is for guiding a typewriter ribbon in lifted and lowered positions relative to slot 8 during printing. A cardholder 24 is carried on the upper end of back 5 as an integral portion thereof. Horizontally centered within cardholder 24 is a type opening 25 which is generally aligned wiht slot 8. The requirements for the dimensions of opening 25 and slot 8 are somewhat different. That is, opening 25 must be (1) located such that it can be properly aligned with a printer platen, and (2) of sufficient width when on-the-fly printing is considered to permit rebound of a print element petal in time to avoid contact with a side of opening 25. While accommodating these requirements, opening 25 is also to be small enough to restrict operator access to print element 2. Also, front 6 and back 5 are spaced sufficiently close together to restrict operator access through either the top or bottom of cartridge 1. Therefore, when print element 2 is housed in cartridge 1, the only area of print element 2 readily contactable by an operator during normal handling of cartridge 1 is that accessible through opening 7.

Figure 2:
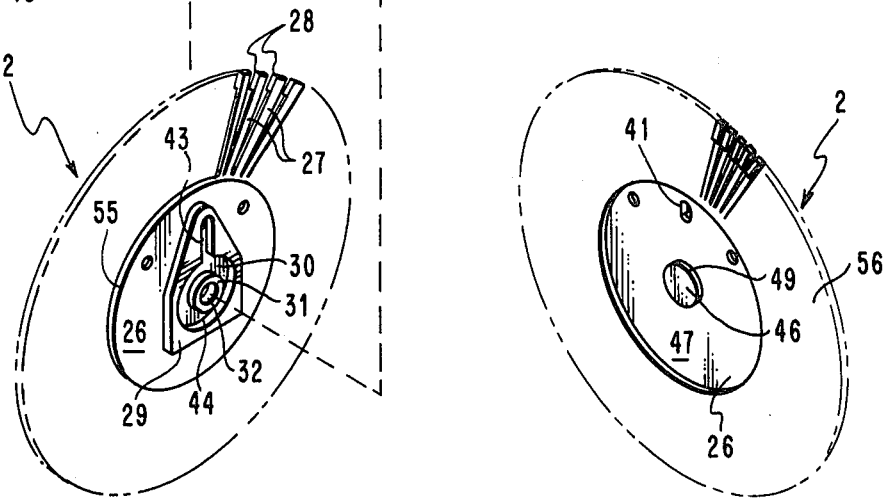
FIG. 2 is a rear perspective view of the print element shown in FIG. 1.

Reference is still to FIG. 1 and now specifically print element 2. As pointed out above, element 2 is to be housed and rotated within cartridge 1 during printing operations. Element 2 is located intermediate the insides of front 6 and back 5 during rotation thereof. Print element 2 is generally daisy wheel in shape and has a central hub 26. Connected to hub 26 are radially extending petals 27. Adjacent the outer extremities of petals 27 are types or character slugs 28 which are utilized in a printing process in a well known manner. Types 28 on petals 27 are located on the printing side of element 2. The opposite side of element 2 is the impact side. On the impact side, petals 27 are structured to be impacted by a print hammer. Referring also to FIGS. 2 and 6, central hub 26 is circular and generally dish shaped in that it has a flanged periphery 55 to which are connected petals 27. Hub 26 carries orientation protrusion 29 on its protruding side as shown. Thus, protrusion 29 is on the impact side of element 2. Protrusion 29 engulfs the axis of rotation of element 2, and has a peripheral arrowhead shape corresponding to opening 7 in cartridge 1. Stated alternatively, opening 7 is a matching opening for protrusion 29. The arrowhead shapes of protrusion 29 and opening 7 are symmetrical with respect to a radius extending vertically and perpendicularly from the axis of rotation of print element 2. Taken as a whole though, these shapes are both asymmetrical and insure one desired orientation of element 2 within cartridge 1.

Within protrusion 29 is a skillet shaped depression 30 also engulfing the axis of rotation of element 2 and having the protruding side of hub 26 as a bottom. Within depression 30 is a cylindrical extension 31 having an opening 32. Opening 32 is axially aligned with the axis of rotation of element 2, and has a bottom 33 below the bottom of depression 30. Opening 32 is for accepting a selection motor drive shaft which extends through hub 3 for centering, and preventing wobble of, element 2 as will be described in greater detail later herein.

Reference is now made specifically to drive hub 3 illustrated in FIGS. 1, 4, and 5. Drive hub 3 is made up of a cylinder 34 connected to a cupped flange 35. Axially centered within cylinder 34 and flange 35 is D-shaped opening 36 extending therethrough. Opening 36 is for accepting a matching selection motor drive shaft 37 having a D-shaped cross-section. D-shaped opening 36 insures a positive rotational connection between shaft 37 and hub 3. Hub 3 is connected along shaft 37 as shown, and may be bonded thereto. If the fit between shaft 37 and opening 32 is sufficiently close, opening 32 is relatively deep, and shaft 37 extends relatively far into opening 32, element 2 is stabilized in a radial direction perpendicular to the axis of rotation of element 2 and shaft 37. That is, any tendency for element 2 to wobble is significantly reduced. Since front 6 and back 5 are to be closely spaced, any wobble of print element 2 on shaft 37 would be particularly undesirable from wear, breakage and free rotation standpoints.

Carried on the periphery of flange 35 is radially extending arm 39. Adjacent the outer end of arm 39 is drive pin 40 structured to communicate with opening 41 (FIG. 2) in element 2. Opening 41 is located in the end of handle 43 of skillet shaped depression 30 and extends through element 2. Pin 40, when inserted into opening 41, is utilized to cause element 2 to rotate upon rotation of shaft 37. Pin 40 and opening 41 have similar peripheries. That is, both have flat sides and arcuate ends.

The width of opening 41 is only slightly larger than the width of pin 40. This is to reduce play between element 2 and hub 3 during rotation of element 2 by hub 3. To accommodate varying tolerances though, the length of opening 41 is somewhat greater than the length of pin 40. Therefore, with the overall size of opening 41 being greater than pin 40, the flat sides provide sufficient driving contact areas to reduce wear and indentation problems. Added support for arm 39 is provided by rib 42. Handle 43 is sufficiently wide to freely accept rib 42.

The outer periphery of flange 35 is greater in diameter than the inner periphery 44 of depression 30. As such, face 45 of flange 35 abuts the face of protrusion 29 for radially aligning and stabilizing element 2 to further aid in reducing print element wobble. A flush fit between face 45 and the stabilizing face of protrusion 29 is aided by spring 48 which urges element 2 toward hub 3. The part played by spring 48 will be more fully discussed later in the specification. An important point to note at this time is that hub 3 is not to be displaced from end 38 of shaft 37 sufficiently for end 38 to completely bottom in opening 32 of element 2. Otherwise, a complete mating of face 45 and the face of protrusion 29 may be prevented. Also, even though the outer periphery of flange 35 is greater than the inner periphery 44, flange 35 is still small enough for hub 3 to be freely passed through opening 7 when properly orientated relative to print element 2 when print element 2 is latched in cartridge 1.

The reason for the pan portion of skillet shaped depression 30 is to reduce the mass of element 2. In like manner, flange 35 is cup shaped to reduce mass. Any reduction in mass results in improved response time in starting and stopping rotation of element 2.

Refer next to FIGS. 2 and 6. In these figures is shown the back or printing side 56 of print element 2. Carried on back 56 is a protruding bearing stud 46 centered within the dished side 47 of central hub 26. Stud 46 extends beyond the dish and is adapted to communicate with spring 48 located in cartridge 1 shown in FIG. 1. Stud 46 is made up of a cylinder 49 carrying a bullet extension 50 having an arcuate cross-section. Bullet 50 acts as a bearing for element 2 against spring 48 during rotation of element 2. Spring 48 in turn acts as a bearing surface for bullet 50. When element 2 is housed in cartridge 1 and not being utilized in a printing process, spring 48 provides a thrust against bullet 50 to bias and maintain element 2 latched in cartridge 1.

Before further discussing the relationship of element 2 and spring 48, several specific details of spring 48 and cartridge 1 will be brought out. Referring to FIG. 3, spring 48 is a leaf spring having a bowed center portion 51 extending toward and located adjacent opening 7. In fact, front 6 and back 5 are spaced, and spring 48 is bowed, such that portion 51 acts against the inside of front 6. Back 5 has an inside rectangular depression 52 for accepting and aiding in retaining spring 48 in a desired position relative to opening 7. That is, spring 48 is to be held in place and remain properly oriented both when bowed as shown and when somewhat extended during the time element 2 is located within cartridge 1 and between spring 48 and front 6. Ends 57 and 58 are located in depression 52 and act against the inside of back 5. Depression 52 is sufficiently long to accommodate spring 48 when extended. Spring 48 is sufficiently long to provide a gradual ramp. Ends 57 and 58 are maintained in depression 52 by front 6 acting against bow 51. Thus, the orientation and length of spring 48, and the extent of bow 51 are such that spring 48 serves as a ramp for bullet 50 of element 2 for camming protrusion 29 toward opening 7 during insertion of element 2 into cartridge 1.

When element 2 is inserted into cartridge 1 from the bottom of cartridge 1, the force of spring 48 must be overcome. As alluded to above, this is because of the proximity of the insides of back 5 and front 6 and the bowed portion 51 acting against the inside of front 6 adjacent opening 7. During insertion of element 2 into cartridge 1, bullet 50 will ride up bow 51. With end 57 seated in depression 52, there will be no snagging of bullet 50 on end 57. When protrusion 29 and opening 7 are aligned, spring 48 will urge and cam protrusion 29 into opening 7 for engagement therewith. Upon engagement of protrusion 29 and opening 7, element 2 is latched in only one properly oriented or desired rotational position within cartridge 1. At this time, the print package made up of element 2 and cartridge 1 is available for either printing use or non-use. For printing use, the print package is inserted into an accepting printer. For printing non-use, the print package can be stored, shipped, etc.

Referring again to the relationship of spring 48 and element 2, the width of spring 48 is of great importance when a print element is to be inserted into an empty cartridge. The horizontal width of spring 48 must be sufficient to eliminate the possibility of a print element petal 27 extending through opening 7 during insertion of element 2 into cartridge 1. If spring 48 is made relatively narrow compared to opening 7, a few petals will be forced out of the plane of the remaining petals. To eliminate this possibility, spring 48 in the illustrated embodiment is made wider than opening 7. This results in all petals adjacent opening 7 remaining in the same plane. The vertical orientation of spring 48 is also important relative to petals 27. That is, since petals 27 are radially extending, there will be no snagging on spring 48 if vertically oriented.

When print element 2 is to be used for printing, cartridge 1 having element 2 latched therein is inserted into an accepting hopper in a daisy wheel printer. Thereafter, drive hub 3 and attached selection motor and shaft are translated toward central hub 26. Shaft 37 will mate with opening 32, pin 40 will mate with opening 41, and face 45 will contact the face of protuberance 29. Further translation of hub 3 in the same direction will result in bullet 50 of element 2 causing ends 57 and 58 of spring 48 to extend in the vertical direction. Ultimately, protrusion 29 will clear opening 7 and element 2 will be unlatched for rotation within cartridge 1. During rotation of element 2 for selection and printing, arm 39 and pin 40 will be located within cartridge 1 and spring 48 will act as a bearing surface for bullet 50.

Referring again to print element 2 in FIGS. 1, 2, and 6, the dish shaped central hub 26 has a number of advantages. One is that due to the structural arrangement disclosed, print element 2 taken as a whole can be made relatively thin and still resist warp. In fact, the thickness of central hub 26, excluding protuberance 29 and stud 46, can be essentially the same as the overall thickness of element 2. Another is that protuberance 29 is brought closer to orientation opening 7. This reduces the chances of interference between the remainder of print element 2 and cartridge 1. Further, due to the relationship of the bow in leaf spring 48 to stud 46, the remainder of print element 2 is spaced from the greater part of spring 48 during rotation of element 2.

For removal of print element 2 from cartridge 1, the operator procedure is to contact protrusion 29 with a thumb and then press in and down. This action results in an unlatching of print element 2 and a downward displacement thereof. If the lower outer periphery of element 2 is relatively close to bottom 15 when element 2 is latched in cartridge 1, very little downward displacement of element 2 is required to supply a sufficient area of element 2 for an operator to grasp. To avoid soiled hands, the operator can simply use a tissue when grasping element 2.

In summary, a print package is provided for a daisy wheel printer. The print package is made up of a daisy wheel print element and a cartridge for housing the print element during both printing and storage. The cartridge is structured to substantially enclose the print element and is adapted to have the print element readily inserted thereinto and removed therefrom. The print element has a dish shaped central hub from which character petals radially extend. On the protruding side of the central hub is an orientation protrusion. A matching orientation opening is provided in the cartridge for accepting (1) the orientation protrusion on the print element prior to and following printing and (2) a selection motor drive hub utilized for rotating the print element during printing. A leaf spring is included in the cartridge for urging the orientation protrusion toward the orientation opening. During storage or shipping the orientation protrusion and orientation opening are in engagement and the print element is latched in a desired rotational position. During printing, the print element is displaced from the orientation opening by the drive hub and the print element is unlatched for rotation within the cartridge.

While the invention has been particularly shown and described with reference to a particular embodiment, it will be understood by those skilled in the art that various changes in form and detail may be made without departing from the spirit and scope of the invention.

What is claimed is:

1. A daisy wheel printer print package comprising in combination:

(a) a daisy wheel print element having an orientation protrusion on one side thereof; and (b) a cartridge (1) made up of a front, a back and sides, wherein said front has an upper portion including ramps which taper upwardly from adjacent said sides, (2) having an open bottom for insertion and removal of said element, (3) substantially enclosing both sides of said element during printing use and non-use, and (4) having a matching opening located in said front for accepting said protrusion for maintaining said element rotationally oriented in one position during printing non-use, wherein said front includes a hammer slot and said back includes a cardholder having a type opening generally aligned with said hammer slot.

2. A package according to claim 1 wherein said element has a dish shaped central hub for carrying said protrusion.

3. A package according to claim 2 wherein the thickness of said central hub relative to the remainder of said element is sufficient to resist warp of said element.

4. A package according to claim 2 wherein said central hub includes a protruding side and a dished side and wherein said protrusion is carried on said protruding side of said central hub.

5. A package according to claim 4 wherein said element has petals radially extending from said central hub, said petals carrying a type adjacent their outer extremity on a side of said element opposite said protrusion.

6. A package according to claim 4 wherein said central hub carries an axially aligned projection within the dished side of said central hub.

7. A package according to claim 6 wherein a portion of said projection extends exterior of said dished side and has an arcuate cross-section.

8. A package according to claim 2 wherein said protrusion has a depression therein.

9. A package according to claim 8 including an axially aligned cylindrical extension extending from the bottom of said depression.

10. A package according to claim 9 wherein said cylindrical extension is hollow.

11. A package according to claim 10 wherein said hollow cylindrical extension has a bottom extending below said depression.

12. A package according to claim 8 wherein said depression has an opening radially offset from the axis of rotation of said element.

13. A package according to claim 12 wherein said radially offset opening is a radially extending opening.

14. A package according to claim 3 wherein the thickness of said central hub is substantially the same as the overall thickness of said element without said protrusion.

15. A package according to claim 1 including a ribbon guide adjacent the top of said front.

16. A package according to claim 15 wherein said front and sides form a shell having internal abutments for supporting said ribbon guide.

17. A package according to claim 1 wherein said front and back have lower portions with guide surfaces which taper downwardly from said sides.

18. A package according to claim 17 wherein said open bottom is coextensive with said guide surfaces.

19. A package according to claim 1 wherein said ramps terminate near the center of said upper portion to form a hammer slot.

20. A package according to claim 1 including biasing means for urging said element toward said front.

21. A package according to claim 20 wherein said biasing means is located between said front and back.

22. A package according to claim 20 wherein said back includes means for retaining said biasing means in place relative to said matching opening.

23. A package according to claim 22 wherein said front and back are spaced from one another such that said biasing means acts against said front when said print element is absent from said cartridge and said front maintains said biasing means in said retaining means.

24. A package according to claim 22 wherein said retaining means is a depression in said back.

25. A package according to claim 24 wherein said depression is located opposite said matching opening.

26. A package according to claim 25 wherein said biasing means is a leaf spring having a center bow extending toward said matching opening.

27. A package according to claim 20 wherein said biasing means is wider adjacent said matching opening than said matching opening.

28. A package according to claim 5 including biasing means for urging said orientation protrusion toward said matching opening.

29. A package according to claim 28 wherein said biasing means is of a sufficient width relative to said matching opening to prevent said petals from extending through said matching opening during insertion of said print element into said cartridge.

30. A package according to claim 6 including biasing means for acting against said axially aligned projection and urging said orientation protrusion toward said matching opening.

31. A package according to claim 30 wherein said biasing means is structured to provide a bearing surface for said axially aligned projection during printing use of said package.

32. A daisy wheel printer print package comprising in combination:

(a) a daisy wheel print element rotationally positionable for printing use and non-use and including means for facilitating orientation of said element; and (b) a cartridge for housing said print element, said cartridge including means for facilitating orientation of said element, both said orientation means of said element and said cartridge being engageable with one another and structured to permit latching of said print element in only one rotational position upon engagement thereof during printing non-use.

33. In a print package including a rotatable print element and a cartridge for housing said print element, wherein the improvement comprises:

(a) means included with said print element for orienting said print element;

(b) means included with said cartridge, engageable and disengageable with said orientation means of said print element, for latching said print element in one rotational position against rotation upon engagement until unlatched for rotation upon disengagement.

34. A print package comprising in combination:

(a) a rotatable print element including orientation means; and (b) a cartridge for housing said print element, said cartridge including orientation means, said orientation means of said element being structured for engagement and disengagement with said orientation means of said cartridge such that upon engagement, said element will be latched in one rotational position against rotation, and upon disengagement, said element will be unlatched for rotation.

35. A print package according to claim 34 wherein said orientation means of said print element is located on one side of said print element.

36. A print package according to claim 35 wherein said orientation means of said print element includes means protruding from said one side of said element.

37. A print package according to claim 34 wherein said orientation means of said cartridge includes an opening in said cartridge.

38. A print package according to claim 37 wherein said opening is asymmetrical in shape with respect to the axis of rotation of said element.

39. A print package according to claim 34 wherein said element and said cartridge are structured for translation relative to one another for engagement and disengagement.

* * * * *